US005701811A

United States Patent [19]

Kawakami

[11] Patent Number: 5,701,811

[45] Date of Patent: Dec. 30, 1997

[54] DIE PROTECTION APPARATUS FOR A HYDRAULIC PRESS

[75] Inventor: Hideaki Kawakami, Komatsu, Japan

[73] Assignees: Komatsu Ltd.; Komatsu Industries Corporation, both of Tokyo, Japan

[21] Appl. No.: 693,200

[22] PCT Filed: Dec. 18, 1995

[86] PCT No.: PCT/JP95/02595

§ 371 Date: Aug. 1, 1996

§ 102(e) Date: Aug. 1, 1996

[87] PCT Pub. No.: WO96/19341

PCT Pub. Date: Jun. 27, 1996

[30] Foreign Application Priority Data

Dec. 21, 1994 [JP] Japan ..... 6-318062

[51] Int. Cl.[6] ..... B30B 15/28

[52] U.S. Cl. ..... 100/50; 100/53; 100/99

[58] Field of Search ..... 100/43, 48–50, 100/53, 99, 269.01

[56] References Cited

U.S. PATENT DOCUMENTS

| | | | |
|---|---|---|---|
| 4,524,582 | 6/1985 | Lucas et al. | 100/48 |
| 4,633,720 | 1/1987 | Dybel et al. | 100/99 |
| 5,379,688 | 1/1995 | Ishii | 100/50 |
| 5,483,874 | 1/1996 | Shimizu et al. | 100/50 |
| 5,491,647 | 2/1996 | O'Brien et al. | 100/50 |

FOREIGN PATENT DOCUMENTS

| | | | |
|---|---|---|---|
| 649839 | 8/1992 | Australia | 100/48 |
| 885102 | 9/1943 | France | 100/50 |
| 62-18280 | 4/1987 | Japan . | |
| 62-109899 | 7/1987 | Japan . | |
| 2-235599 | 9/1990 | Japan | 100/99 |
| 3-81099 | 4/1991 | Japan | 100/99 |
| 4-55100 | 2/1992 | Japan . | |
| 4-45330 | 7/1992 | Japan . | |
| 5-269600 | 10/1993 | Japan | 100/48 |

*Primary Examiner*—Stephen F. Gerrity

*Attorney, Agent, or Firm*—Frishauf, Holtz, Goodman, Langer & Chick

[57] ABSTRACT

There is provided a die protection apparatus for a hydraulic press in which a slide is moved up and down by a hydraulic cylinder, which apparatus comprises: a slide position detection means for detecting a position of the said slide; a pressure detection means for detecting a pressure that is applied to the said slide; a setting means for setting a threshold value of the said applied pressure and a predetermined position of the said slide which are required to form a workpiece in accordance with a die used; and an emergency stop means which, if a working pressure develops that exceeds the said threshold value at any position in a workpiece forming zone, is so operative as to determine the said working pressure to be abnormal, thereby emergency stopping the said slide.

9 Claims, 5 Drawing Sheets

DIE PROTECTION APPARATUS FOR A HYDRAULIC PRESS

TECHNICAL FIELD

The present invention relates to a die protection apparatus for a hydraulic press that acts to prevent a die from being damaged under an excessive load.

BACKGROUND ART

In a hydraulic press for forming a workpiece by the use of a pair of dies which constitute an upper die and a lower die, there has hitherto been encountered a problem that either or both of the dies may be damaged due to an excessive load when locally generated upon the same if a foreign matter, i. e. something other than a workpiece, has been intruded between the upper and lower dies while the workpiece is being formed.

In order to obviate such a problem, there have been proposed a variety of die protection arrangements in the prior art.

For example, in Japanese Examined Patent Publication No. Sho 62-18280 there is disclosed an apparatus for protecting both an upper die and a lower die from an excessive load when it is exerted thereon due to a foreign matter that has been present between these dies of a press in the hydraulic press equipment, which dies are movable in its operating process directions by a booster cylinder piston unit with at least one ram and at least one hydraulic ram drive unit. An apparatus of this class is provided on a press machine frame with a limit switch that is designed to monitor the ram working operation. The apparatus is also provided with a pressure sensor which is arranged on a line of action of the at least one booster cylinder piston unit so that while the ram is being moved in a working direction thereof the pressure sensor may be responsive to an abnormal state in the resistance of such a movement. The apparatus for the hydraulic press equipment for protecting both the upper and lower dies is further provided with a control circuit for effecting a stop of the ram, which circuit is configured to provide an error detection signal when the limit switch is operatively responsive after the pressure sensor has been made operatively responsive.

Also, in Japanese Examined Patent Publication No. Hei 4-45330 there is disclosed a press for forming a thermo setting resinous material, which includes a bed for mounting a lower die thereon, a slide movable up and down for mounting an upper die thereto, a pressure cylinder for moving the said slide downwards, four leveling cylinders mounted, respectively, at the four corners of the above mentioned base and adapted to be detachably into abutting contact with the lower surface of the above mentioned slide, a servo pump for supplying the above mentioned pressure cylinder with an operating fluid, a hydraulic pump for supplying the above mentioned leveling cylinders with an operating fluid, a pressure control valve interposed in a hydraulic circuit between the above mentioned servo pump and the above mentioned pressure cylinder, a servo valve interposed in a hydraulic circuit between the above mentioned hydraulic pump and each of the above mentioned leveling cylinders, a pressure detecting means for detecting a pressure in the above mentioned pressure cylinder and a control means which is designed to control the above mentioned servo valve so as to maintain a balance of the above mentioned slide and which, when the value detected by the above mentioned detecting means reaches a predetermined value, is adapted to switch the control of the above mentioned pressure cylinder from a mode of controlling its velocity by means of the above mentioned servo pump to a mode of controlling its pressure by the above mentioned pressure control valve.

It should be noted, however, that in an apparatus of the former class in which the position of the ram that has been located to a predetermined position is detected by the limit switch and the load that has previously be generated between the upper and lower dies is detected by the pressure sensor to determine a said load to be abnormal when it exceeds a predetermined value. Therefore, an only abnormality in the predetermined location can be detected and if the dies are variously altered there may still develop an inconvenience that it is incapable of setting an abnormality detecting condition that is optimum for an altered die set.

On the other hand, in an apparatus of the latter class in which since the only pressure control can be effected when the slide lies in the vicinity of its lower dead point, it is noted that if the stress from a workpiece is decreased in the vicinity of the lower dead point the dies will have to bear the load applied. As a result, there has still been an inconvenience such as the presence of the fear that the die or dies may be damaged.

The present invention has been made in order to eliminate such inconveniences in the prior art and has for its object to provide a die protection apparatus for a hydraulic press, which can protect the dies by detecting a development of abnormality at any location throughout the movement of the slide, thereby preventing a die from being damaged under an excessive load.

SUMMARY OF THE INVENTION

In order to achieve the object mentioned above, there is provided in accordance with the present invention, in a first general form of embodiment thereof, a die protection apparatus for a hydraulic press in which a slide is moved up and down by a hydraulic cylinder, which apparatus comprises: a slide position detection means for detecting a position of the said slide; a pressure detection means for detecting a pressure that is applied to the said slide; a setting means for setting a threshold value of the said applied pressure and a predetermined position of the said slide which are required to form a workpiece in accordance with a die used; and an emergency stop means which, if a working pressure develops that exceeds the said threshold value at any position in a workpiece forming zone, is so operative as to determine the said working pressure to be abnormal, thereby emergency stopping the said slide.

According to the above mentioned construction in which if a working pressure on the slide develops that exceeds a preset threshold value, an emergency stop means is made operative to emergency stop the said slide, it should be noted that it will be made possible to prevent a die from being damaged under an excessive load while at the same time the ability to detect an abnormality pursuant to a set of dies and a workpiece used will, if the die set and the workpiece are altered, enable a damage of the dies to be prevented without fail.

The present invention also provides, in a second general form of embodiment thereof, a die protection apparatus for a hydraulic press in which a slide is moved up and down by a hydraulic cylinder, which apparatus comprises: a slide position detection means for detecting a position of the said slide; a pressure detection means for detecting a pressure that is applied to the said slide; a setting means for setting a threshold value of the said applied pressure and a predetermined position of the said slide which are required to form a workpiece in accordance with a die used; and an emergency stop means which, if a working pressure develops that exceeds the said threshold value at a position which is higher than the said set slide position for a given die in a workpiece forming zone, is so operative as to determine the said working pressure to be abnormal, thereby emergency stopping the said slide.

According to the construction just mentioned above, it should be noted that by preliminarily setting an optimum slide position (a first position) in accordance with a given die set to be used, the slide is capable of being emergency stopped by the said emergency stop means even if a working pressure that exceeds the said threshold value develops when the slide is located at a position that is higher than the said set position.

The present invention also provides, in a third aspect thereof, a die protection apparatus for a hydraulic press in which a slide is moved up and down by a hydraulic cylinder, which apparatus comprises: a slide position detection means for detecting a position of the said slide; a pressure detection means for detecting a pressure that is applied to the said slide; a setting means for setting, for a given die used, an optimum slide position at which an abnormal load is not applied to the said die; and an emergency stop means which, if the said slide is lowered from the said optimum position set by the said setting means in a workpiece forming zone, is so operative as to determine this to be abnormal, thereby emergency stopping the said slide.

According to the construction just mentioned above, it should be noted that by preliminarily setting an optimum slide position (a second position) in accordance with a given die set to be used, the slide is capable of being emergency stopped by the said emergency stop means if the slide is further lowered from the said optimum position. Accordingly, if the stress from a workpiece is reduced with the progress of deformation thereof while it is being formed, the dies will no longer need to bear the pressure applied and hence the dies can be prevented from being damaged under an excessive load.

It should be noted at this point that it is preferred that the die protection apparatus according to the present invention should further comprise an electromagnetic flow rate proportional control valve for supplying a pressurized fluid into said hydraulic cylinder and that the said electromagnetic flow rate proportional control valve should be adapted to be closed by means of the said emergency stop means, whereby the said slide is emergency stopped.

In the construction mentioned above, the die protection apparatus according to the present invention may further comprise a hydraulic pump and a pressure proportional valve which is disposed in a discharge circuit of the said hydraulic pump, and the said pressure proportional valve may be adapted to be opened by the said emergency stop means to unload a discharge pressure of the said hydraulic pump, whereby the said slide is emergency stopped.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

BEST MODES FOR CARRYING OUT THE INVENTION

Hereinafter, suitable embodiments of the present invention with respect to a die protection apparatus for a hydraulic press will be set forth with reference to the accompanying drawings hereof.

A detailed explanation will now be given of a certain embodiment of the present invention with references to those drawings.

Figure 1:
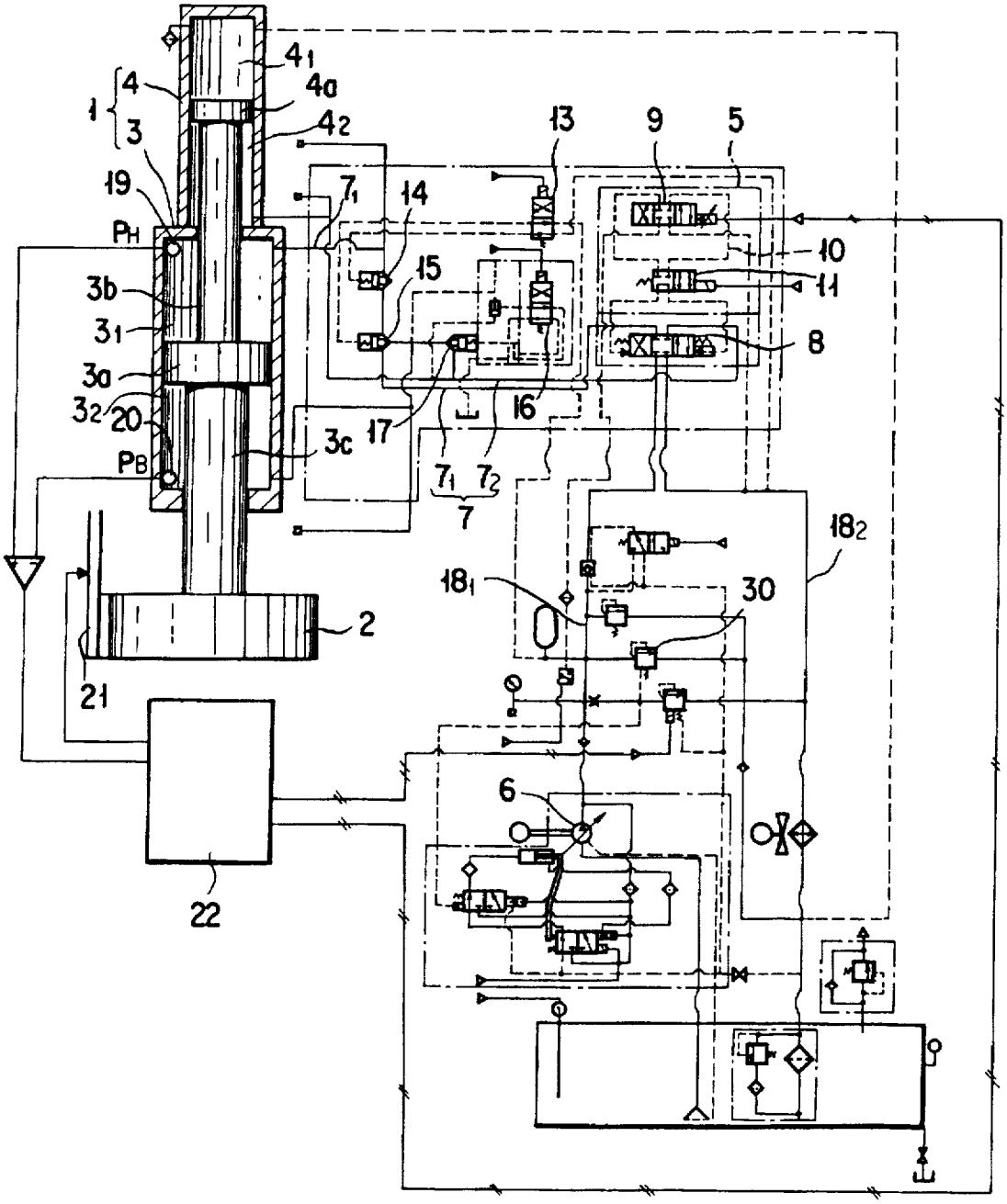
FIG. 1 is a circuit diagram schematically illustrating a hydraulic circuit for a press equipment, incorporating a certain embodiment of the die protection apparatus according to the present invention.
Figure 2:
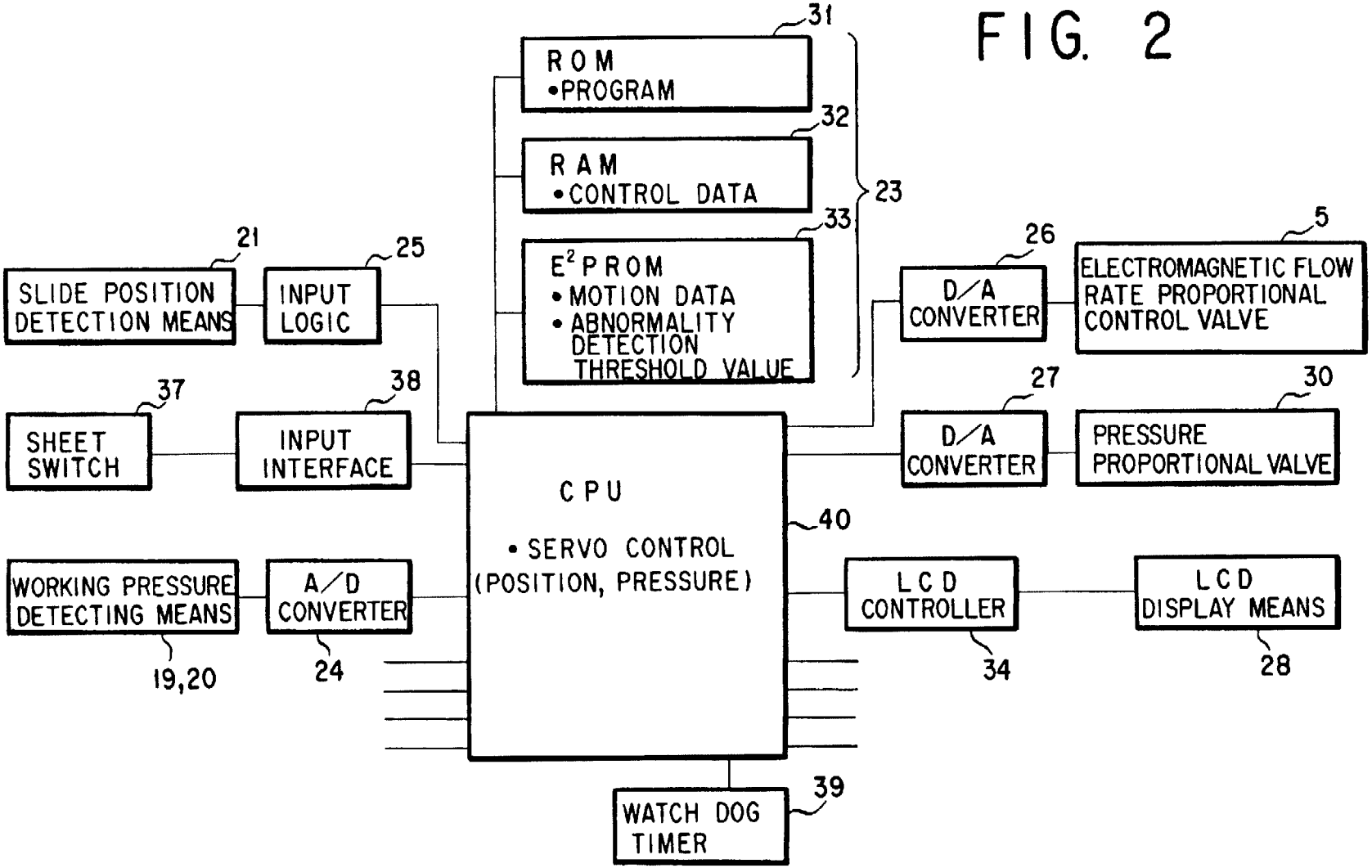
FIG. 2 is block diagram schematically illustrating the interior of a controller that may be contained in the above mentioned embodiment of the present invention.

FIG. 1 shows a circuit diagram illustrating a hydraulic circuit for a hydraulic press, incorporating a certain embodiment of the die protection apparatus according to the present invention; and FIG. 2 shows a block diagram illustrating the interior of a controller that can be used in the above mentioned embodiment of the present invention.

In FIG. 1, there is shown a hydraulic cylinder 1 for moving up and down a slide 2. The hydraulic cylinder 1 comprises a first cylinder 3 that is larger in diameter and a second cylinder 4 that is smaller in diameter and is provided coaxially with the first cylinder 3. A piston 3*a* is haused in the first cylinder 3 and has an upper surface and a lower surface from which piston rods 3*b* and 3*c* project, respectively, upwards and downwards.

The piston rod 3*b* that projects from the upper surface of the piston 3*a* has a diameter that is smaller than the diameter of the piston rod 3*c* which projects from the lower surface of the piston 3*c*. The upper side of the piston rod 3*b* is projected into the second cylinder 4 and its upper end has a piston 4*a* attached thereto which is received in the second cylinder 4. The lower end of the larger diameter piston rod 3*c* projecting from the lower surface of the piston 3*a* has the above mentioned slide 2 attached thereto.

Also in FIG. 1, there is shown an electromagnetic flow rate proportional control valve 5 which is constructed of a servo valve 8 that is disposed midway of a conduit line 7 for applying a fluid discharge pressure of a pump 6 to the first cylinder 3 and the second cylinder 4; an electromagnetic proportional control valve 9 for pilot controlling the said servo valve 8; and an on/off valve 11 that is disposed midway of a pilot circuit 10 for connecting the said electromagnetic proportional control valve 9 and the said servo valve 8 to each other.

And, the said conduit line 7 that connects the above mentioned servo valve 8 and the above mentioned first cylinder 3 to each other is divided into a first conduit line $7_1$ that is connected to the side of an upper chamber $3_1$ of the first cylinder 3 and a second conduit line $7_2$ that is connected to a lower chamber $4_2$ of the second cylinder 4. The said first conduit line $7_1$ and a lower chamber $3_2$ of the said first cylinder 3 are interconnected by an electromagnetic valve 13 via a pair of logic valves 14 and 15 which can be opened and closed jointly. On the other hand, the one logic valve 25 and the said second conduit line $7_2$ are interconnected via a further logic valve 17 which can be opened and closed by an electromagnetic valve 16. Also, the said second cylinder 2 has an upper chamber $4_1$ that is open to the atmosphere.

Further, a pair of conduit lines $18_1$ and $18_2$ are provided to interconnect the above mentioned hydraulic pump 6 and the above mentioned electromagnetic flow rate proportional control valve 5 while having a pressure proportional valve 30 connected between them for adjusting the fluid discharge pressure of the hydraulic pump 6 with its opening being adjusted in response to a control signal from a controller 22 that will be described later.

On the other hand, the said upper chamber $3_1$ and the said lower chamber $3_2$ of the above mentioned first cylinder 3 are provided with a pair of working pressure detection means 19 and 20, respectively, each comprising a pressure sensor for detecting a working pressure P from the pressure within each chamber $3_1$, $3_2$. Also, in the vicinity of the above mentioned slide 2 there is provided a slide position detection means 21 for detecting a position of the slide 2. And, the pressure and position signals which are detected by these detection means 19, 20 and 21 are provided as inputs to the controller 22.

The above mentioned controller 22, as shown in FIG. 2, is constructed of a CPU 40; a memory means 23 that comprises a ROM 31 in which a control program is preliminarily stored, a RAM 32 for storing control data and $E^2$PROM 33 for storing motion data; an interface 24 that comprises an A/D converter for converting analog signals detected by the pressure detection means 19 and 20 into digital signals and providing the digital signals as inputs to the CPU 40; an input interface 38 for providing a signal from a sheet switch 37 for data entry as an input to the CPU 40; an interface 25 that comprises an input logic for providing a signal detected by the slide position detection means 21 such as a position sensor as an input to the CPU 40; a D/A converter 26 for converting a control digital signal furnished from the CPU 40 to an analog signal and providing as an output signal the analog signal to the above mentioned electromagnetic flow rate proportional control valve 5; a D/A converter 27 for converting control digital signal furnished from the CPU 40 to an analog signal and providing as an output signal the analog signal to the above mentioned pressure proportional control valve 30; a liquid crystal display means 28 for displaying a controlled state via a liquid crystal controller 34; and a watch dog timer 39 for monitoring the processing time period of the CPU 40 and determining the CPU 40 to be in a failure if the monitored processing time period exceeds a normal processing time period.

Figure 3:
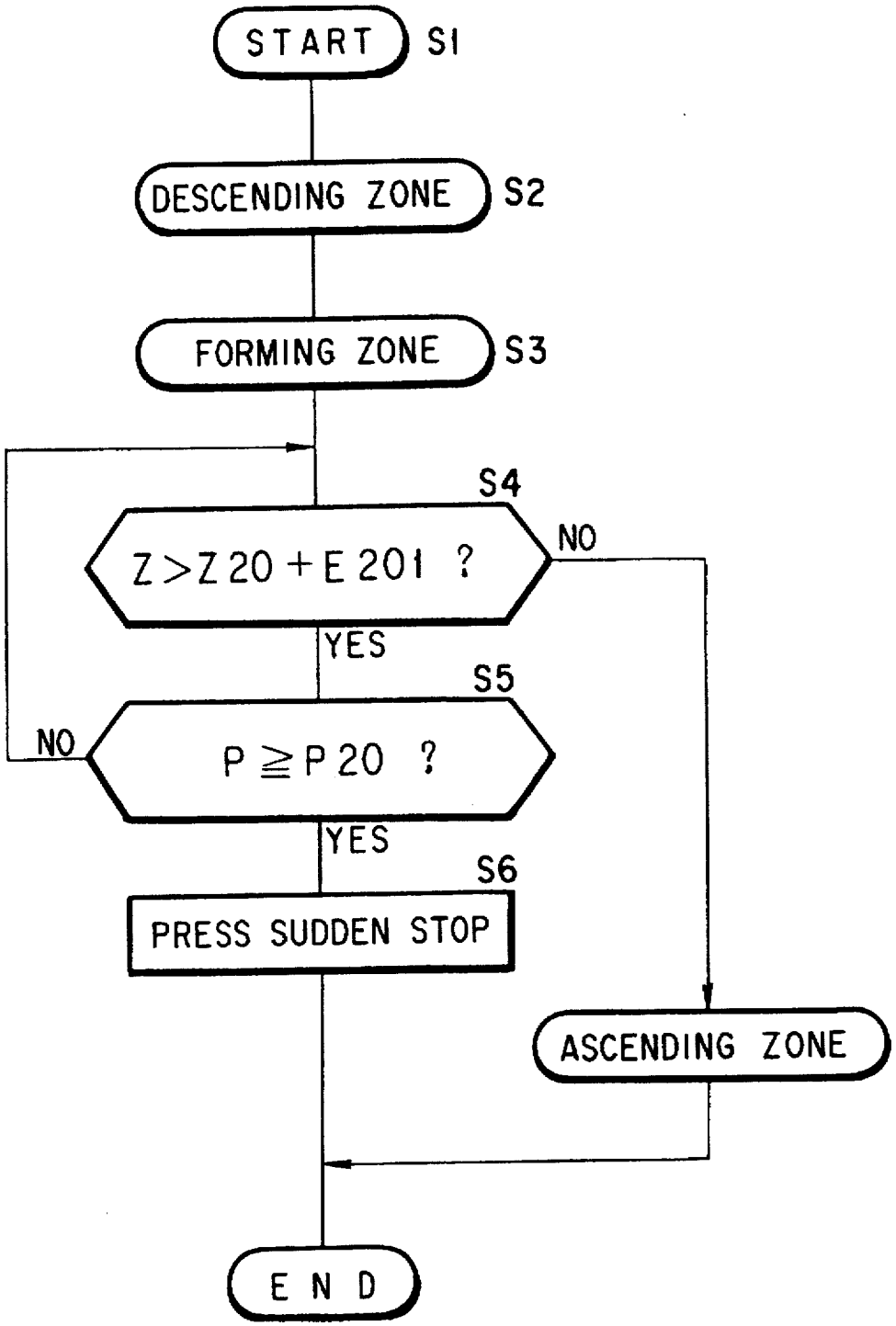
FIG. 3 is a flow chart schematically illustrating a slide control method by using the above mentioned embodiment in accordance with the present invention.
Figure 4:
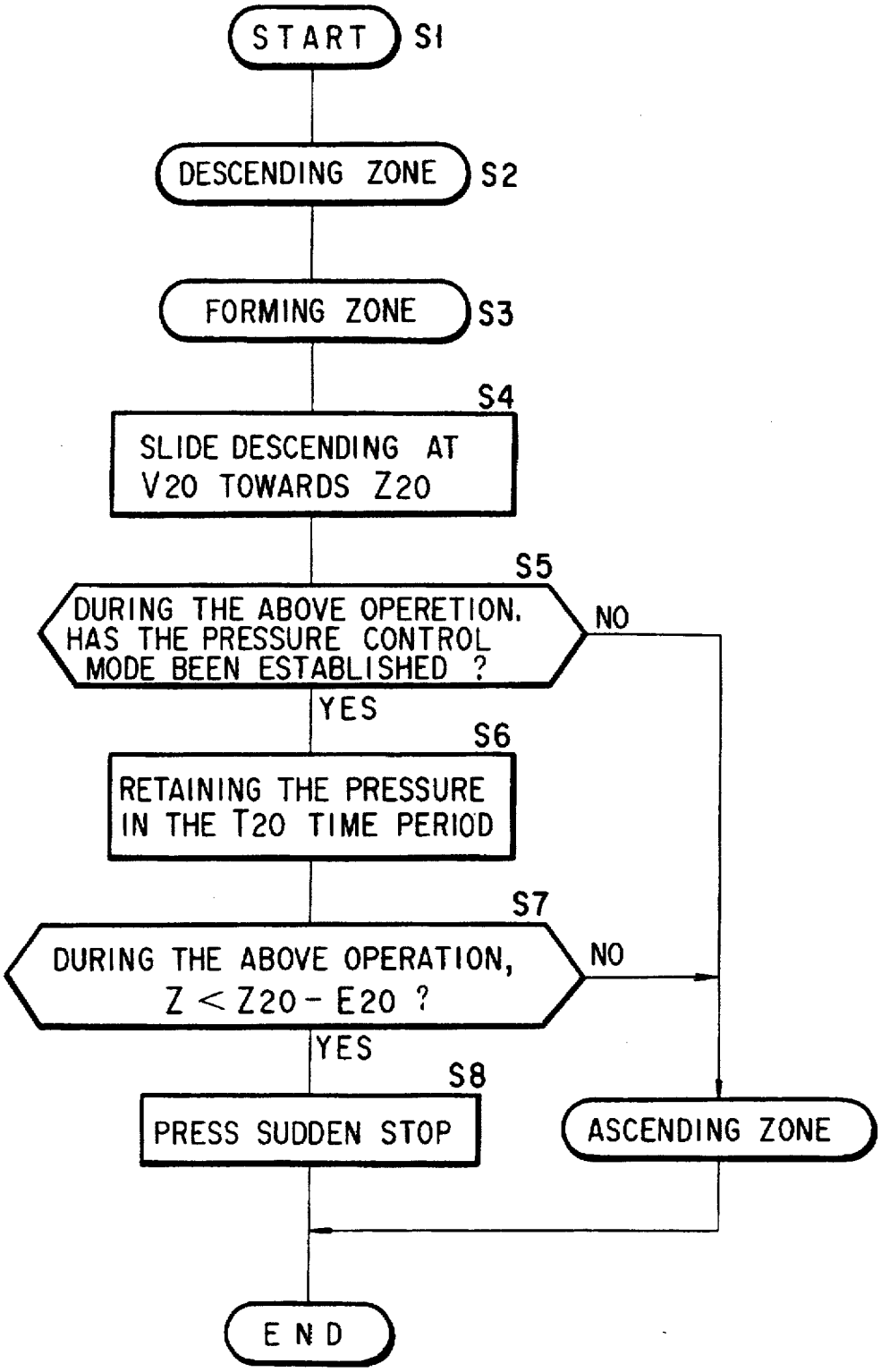
FIG. 4 is a flow chart schematically illustrating an alternative slide control method using the above mentioned embodiment in accordance with the present invention.
Figure 5:
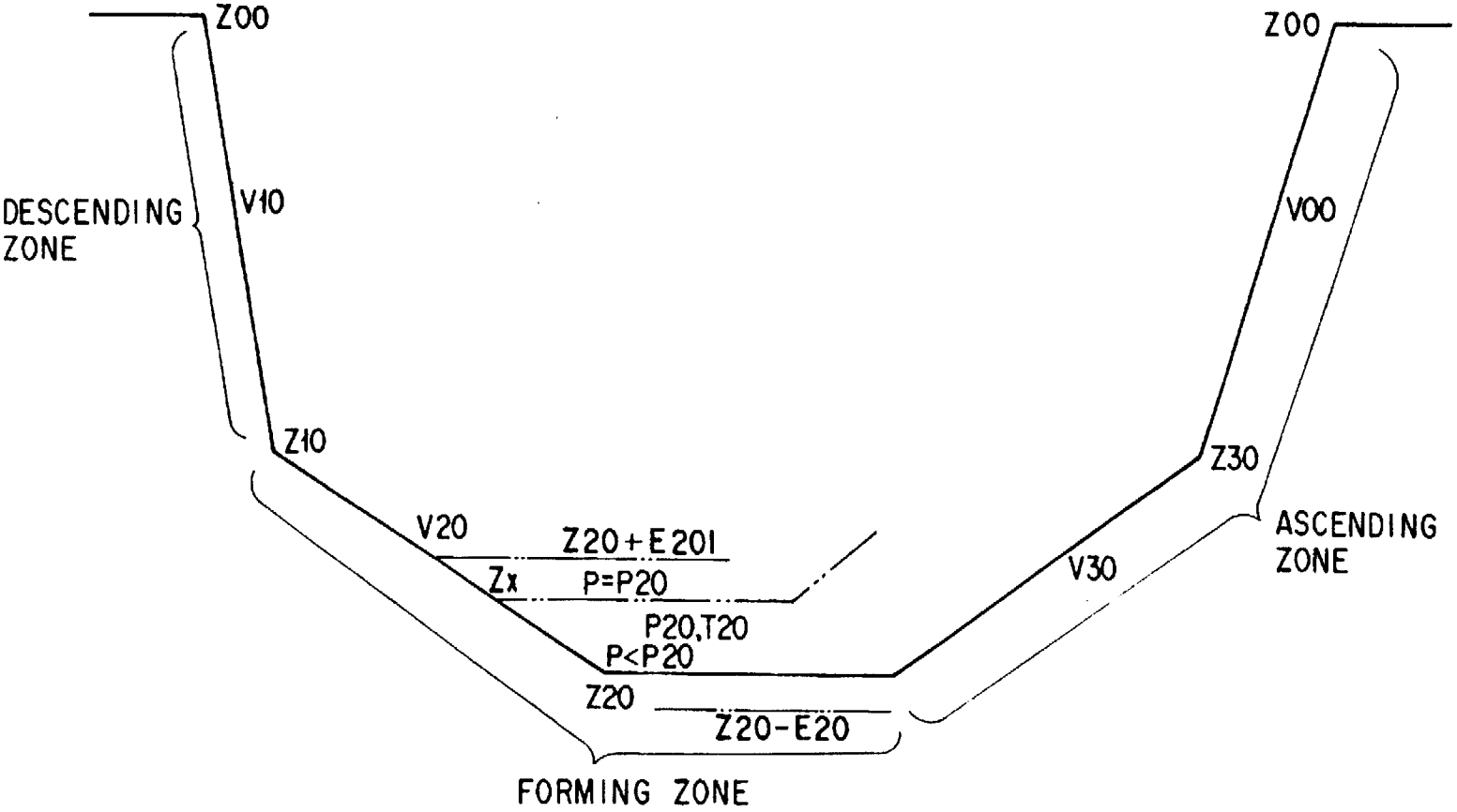
FIG. 5 is a graph diagrammatically illustrating the motion of a slide in a hydraulic press that is provided with the above mentioned embodiment in accordance with the present invention.

An explanation will now be given with respect to the control of a slide motion with reference to FIGS. 3 to 5.

First, in initiating a forming operation for a workpiece, the operating parameters for a slide motion will be set up such as the position data: Z00~Z30, the velocity data: V00~V30, the pressure capacity data: P20, the pressure retaining time data: T20 and so forth; then, they will be entered by using the sheet switch 37.

Next, when a hydraulic pressing operation is initiated, a starting signal will be entered from an operating button (not shown) to cause the electromagnetic flow rate proportional control valve 5 to be switched and, at the same time, to cause the logic valves 14 and 15 to be opened by the electromagnetic valve 13. The, the fluid discharge pressure of the hydraulic pump 6 will reach the upper chamber $3_1$ of the first cylinder 3 via the servo valve 8, the conduit line $7_1$ and the logic valves 14 and 15. At the same time, the fluid in the lower chamber $3_2$ of the first cylinder 3 will be merged at the logic valve 15 with the discharged pressure fluid of the hydraulic pump 6 and the merged fluid will then be delivered into the upper chamber $3_1$ of the first cylinder 3. Therefore, a difference in pressure receiving area between the upper chamber $3_1$ and the lower chamber $3_2$ will cause the piston 3*a* to be pushed downwards and will cause the slide 2 to initiate to descend at a preset high velocity V10 from a upper dead point Z00 as shown in FIG. 5 (the step S2 in the flow chart shown in FIG. 3).

Also, throughout the descending zone for the slide 2, the pressures in the upper chamber $3_1$ and the lower chamber $3_2$ will be detected by the pressure detection means 19 and 20 and the position of the slide 2 will be detected by the slide position detection means 21, each to provide a detection signal which will then be furnished as an input to the controller 22.

After that, when the slide is lowered to the position Z10 to reach a workpiece forming zone (the step S3), it will be determined in the step 4 whether or not the position Z of the slide 2 is above the height [Z20+E201] that is optimum for a set of dies as have preliminarily been entered into the said controller 22 and as have been stored in the said memory means 23 (i. e., the height which is optimum for the judgment of an abnormality and is to be entered for each die set used). If it is above the said height, the process will proceed to the step 5 where it should be determined whether or not the pressure generated in the said hydraulic cylinder 1 has reached a preset value P20 of the pressure that is required for the workpiece to be formed by the die set then used. It should be noted at this point that if the position Z of the slide 2 is below the above mentioned optimum height, the step will be terminated so that the process may proceed to the end after having undergone the ascending zone.

And, if the generated pressure P has reached the preset value P20 set for the die set given or has exceeded the said value, the process will proceed to the step 6 where the descending slide 2 will be emergency stopped by an emergency stop means. Actually, a sudden stop signal will be furnished from the said controller 22 to the said electromagnetic flow rate proportional control valve 5 to instantaneously close the said valve 5. As an alternative, by the fact that the said pressure control valve 30 disposed in the fluid discharge circuit of the said hydraulic pump 6 will be opened to unload the discharge pressure of the hydraulic pump 6, the slide 2 will at that position be emergency stopped. Here it should be noted that if the generated pressure P has not reached the preset value P20 set for the die set given, the process will again be returned to the step 4.

It can thus be seen that if a foreign matter happens to be intruded between the upper and lower dies so that an excessive load may be exerted upon the dies, the slide will be emergency stopped. It follows therefore that a die can be prevented from being damaged under any excessive load whatsoever.

On the other hand, if the preset pressure P20 is reached by a pressure P that will be generated if the position Z of the slide 2 in the forming zone descends down to a position that is lower than the height [Z20+E201] which is optimum for the die set given, the said controller 22 will act to switch the position priority mode over to the pressure priority mode so as to pressure control the said electromagnetic flow rate proportional control valve 5. Now, an explanation will be given with respect to the detection of an abnormality during this pressure control operation with reference to the flow chart shown in FIG. 4.

When the process has reached the forming zone of the step 3, the slide 2 will be descending towards a lower dead point Z20 at a velocity V20 that has been preset in the step S4. Then, the said controller 22 will determine whether or not the pressure control mode has been established in the step S5. If the pressure control mode has been switched over, the process will proceed to the step S6 where a given pressure will be maintained for a preset time period T20. On the contrary, if the pressure control mode has not been established, this step will be terminated so that the process may go to the end after having undergone the ascending zone.

And, the process in the meantime will proceed to the step 7 where if the slide 2 had descended down to a position it should be determined whether or not the slide 2 has descended from that position [Z20–E20] (which is preset) at which an excessive load is not exerted upon the dies. If the slide 2 is determined to have so descended, the process will judge this to be abnormal so that the slide 2 may be emergency stopped by the said emergency stop means in the step 8. On the contrary, if the slide 2 is determined not to have descended from a position at which an excessive load is not exerted on the said dies, the process having undergone the ascending zone will go to the end.

Thus, it follows therefore that such a damage of a die can successfully be prevented as will be accrued from an abnormal load thereon arising from the fact that if the deformation of a workpiece during its forming operation proceeds to the extent that a stress from the workpiece is reduced, the slide 2 should further descend from the preset position.

As set forth in the foregoing, it can be seen that according to the present invention in which if a working pressure which exceeds a threshold value that is preliminarily set at an optional descending position of the slide in the forming zone is developed to act on the slide, the emergency stop means is adapted to emergency stop the slide, any potential damage on a die under an excessive load can be prevented and at the same time the ability to make a detection of any abnormality in accordance with a set of die and a workpiece used can effectively prevent a die from being damaged without fail if the workpiece and the die set should variably be used.

Also, according to the present invention in which by preliminarily setting a slide position (the first position) which is optimum for a die set to be used, if a working pressure is generated which exceeds a threshold value at a position that is higher than the preset position the slide can be emergency stopped by the emergency stop means whereas by preliminarily setting a slide position (the second position) which is optimum for a die set to be used, if the slide is further lowered from the optimum slide position the slide can be emergency stopped by the emergency stop means, it can be seen that if the deformation of a workpiece during its forming operation proceeds to the extent that a stress from the workpiece is reduced, the dies will not have to bear the pressure applied thereto and hence any damage whatsoever of a die under an excessive load can successively be prevented.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A die protection apparatus for a hydraulic press in which a slide is moved up and down by a hydraulic cylinder, the apparatus comprising:

a slide position detection means for detecting a position of said slide;

a pressure detection means for detecting a pressure that is applied to said slide;

a setting means for setting a threshold value of said applied pressure and a predetermined position of said slide which are required to form a workpiece in accordance with a die used; and an emergency stop means which, if a working pressure develops that exceeds said threshold value at any position in a workpiece forming zone, is so operative as to determine said working pressure to be abnormal, thereby emergency stopping said slide.

2. A die protection apparatus as set forth in claim 1, further comprising an electromagnetic flow rate proportional control valve for supplying a pressurized fluid into said hydraulic cylinder, in which said electromagnetic flow rate proportional control valve is adapted to be closed by means of said emergency stop means, whereby said slide is emergency stopped.

3. A die protection apparatus as set forth in claim 1, further comprising a hydraulic pump and a pressure proportional valve that is disposed in a discharge circuit of said hydraulic pump, in which said pressure proportional valve is adapted to be opened by said emergency stop means to unload a discharge pressure of said hydraulic pump, whereby said slide is emergency stopped.

4. A die protection apparatus for a hydraulic press in which a slide is moved up and down by a hydraulic cylinder, the apparatus comprising:

a slide position detection means for detecting a position of said slide;

a pressure detection means for detecting a pressure that is applied to said slide;

a setting means for setting a threshold value of said applied pressure and a predetermined position of said slide which are required to form a workpiece in accordance with a die used; and an emergency stop means which, if a working pressure develops that exceeds said threshold value at a position which is higher than said set slide position for a given die in a workpiece forming zone, is so operative as to determine said working pressure to be abnormal, thereby emergency stopping said slide.

5. A die protection apparatus as set forth in claim 4, further comprising an electromagnetic flow rate proportional control valve for supplying a pressurized fluid into said hydraulic cylinder, in which said electromagnetic flow rate proportional control valve is adapted to be closed by means of said emergency stop means, whereby said slide is emergency stopped.

6. A die protection apparatus as set forth in claim 4, further comprising a hydraulic pump and a pressure proportional valve that is disposed in a discharge circuit of said hydraulic pump, in which said pressure proportional valve is adapted to be opened by said emergency stop means to unload a discharge pressure of said hydraulic pump, whereby said slide is emergency stopped.

7. A die protection apparatus for a hydraulic press in which a slide is moved up and down by a hydraulic cylinder, the apparatus comprising:

a slide position detection means for detecting a position of said slide;

a pressure detection means for detecting a pressure that is applied to said slide;

a setting means for setting, for a given die used, an optimum slide position at which an abnormal load is not applied to said die; and an emergency stop means which, if said slide is lowered from said optimum position set by said setting means in a workpiece forming zone, is so operative as to determine this to be abnormal, thereby emergency stopping said slide.

8. A die protection apparatus as set forth in claim 7, further comprising an electromagnetic flow rate proportional control valve for supplying a pressurized fluid into said hydraulic cylinder, in which said electromagnetic flow rate proportional control valve is adapted to be closed by means of said emergency stop means, whereby said slide is emergency stopped.

9. A die protection apparatus as set forth in claim 7, further comprising a hydraulic pump and a pressure proportional valve that is disposed in a discharge circuit of said hydraulic pump, in which said pressure proportional valve is adapted to be opened by said emergency stop means to unload a discharge pressure of said hydraulic pump, whereby said slide is emergency stopped.

* * * * *